US007138605B1

(12) United States Patent
Smith

(10) Patent No.: US 7,138,605 B1
(45) Date of Patent: Nov. 21, 2006

(54) BATTERY POWERED ELECTRIC CIGARETTE LIGHTER WITH EXTRA BATTERY STORAGE CASE

(76) Inventor: Colby R. Smith, 3124 Crane Creek Rd., Boise, ID (US) 83702

( * ) Notice: Subject to any disclaimer, the term of this patent is extended or adjusted under 35 U.S.C. 154(b) by 119 days.

(21) Appl. No.: 10/947,269

(22) Filed: Sep. 23, 2004

(51) Int. Cl.
*F23Q 7/00* (2006.01)

(52) U.S. Cl. ..... 219/268

(58) Field of Classification Search ..... 219/268–269, 219/262–263, 267, 260, 533, 535
See application file for complete search history.

(56) References Cited

U.S. PATENT DOCUMENTS

| | | | | |
|---|---|---|---|---|
| 981,987 | A * | 1/1911 | Extrom et al. | 219/268 |
| 1,505,248 | A * | 8/1924 | Extrom | 219/270 |
| 2,676,237 | A * | 4/1954 | Tooker, Jr. | 219/263 |
| 2,748,246 | A * | 5/1956 | Lewis | 219/267 |
| 3,343,040 | A * | 9/1967 | Rabe | 361/247 |
| 3,392,265 | A * | 7/1968 | King et al. | 219/267 |
| 3,419,704 | A * | 12/1968 | Hunt | 219/268 |
| 3,444,435 | A | 5/1969 | Halm | |
| 3,448,365 | A | 6/1969 | Jacobson | |
| 3,934,302 | A | 1/1976 | Mabuchi | |
| 4,616,665 | A | 10/1986 | Cho | |
| D307,061 | S | 4/1990 | Nitta | |
| D364,245 | S | 11/1995 | Anderson | |

FOREIGN PATENT DOCUMENTS

| | | | |
|---|---|---|---|
| CH | 149162 | * | 8/1931 |
| CH | 179587 | * | 9/1935 |

* cited by examiner

*Primary Examiner*—Daniel Robinson
(74) *Attorney, Agent, or Firm*—Donald R. Schoonover

(57) ABSTRACT

An electric cigarette lighter includes a housing which has finger grips and a case for storing extra batteries. The lighter includes a resistive element that becomes heated when the lighter is activated and attains a temperature sufficient to light a cigarette or other such element, even if exposed to wind, rain or other environmental factors.

1 Claim, 2 Drawing Sheets

BATTERY POWERED ELECTRIC CIGARETTE LIGHTER WITH EXTRA BATTERY STORAGE CASE

BACKGROUND OF THE INVENTION

1. Field of the Invention

The present invention relates to the general art of electric heating devices, and to the particular field of resistive element igniter type electric heating devices.

2. Discussion of the Related Art

Many people require the use of a lighter while out of doors. The lighter can be used to light cigarettes, campfires or the like. The lighter is ignited and is then used to ignite the item of interest.

In the past, people have used matches as well as cigarette lighters for this purpose. When out of doors, these igniters are susceptible to being blown out by wind, rain or like environmental factors. This can be extremely frustrating, especially if the person has a limited time or a limited supply of igniter material.

Therefore, there is a need for an igniter device that is not susceptible to environmental factors such as wind, rain or the like.

Still further, using a cigarette lighter out of doors may require the user to maintain a firm grasp on the lighter, such as when the lighter is being used by a fisherman whose hands may be damp and slippery. Dropping a cigarette lighter overboard is obviously an undesirable situation.

Therefore, there is a need for an igniter device that is not susceptible to environmental factors such as wind, rain or the like, and which can be firmly gripped.

Another source of frustration is a lighter device that is out of fuel. If one is using matches, the eminent exhaustion of match supply will be apparent; however, if one is using a hand-held lighter device, such loss of fuel will not be so apparent. A user is therefore required to remember to fuel his lighter periodically.

Therefore, there is a need for an igniter device that is not susceptible to environmental factors such as wind, rain or the like, and which can be firmly gripped and which is less likely to run out of power than prior art devices.

PRINCIPAL OBJECTS OF THE INVENTION

It is a main object of the present invention to provide an igniter device that is not susceptible to environmental factors such as wind, rain or the like.

It is another object of the present invention to provide an igniter device that is not susceptible to environmental factors such as wind, rain or the like, and which can be firmly gripped.

It is another object of the present invention to provide an igniter device that is not susceptible to environmental factors such as wind, rain or the like, and which can be firmly gripped and which is less likely to run out of power than prior art devices.

SUMMARY OF THE INVENTION

These, and other, objects are achieved by an electric cigarette lighter that has a housing with finger grip areas and a battery pack that permits storage of extra batteries.

The cigarette lighter embodying the present invention is thus firmly gripped and has a place to store backup batteries that are easily accessed in the event the batteries in the device become exhausted or fail. The electric nature of the lighter makes it less susceptible to environmental factors than igniters that use flames.

BRIEF DESCRIPTION OF THE DRAWING FIGURES

DETAILED DESCRIPTION OF THE PREFERRED EMBODIMENT

Figure 3:
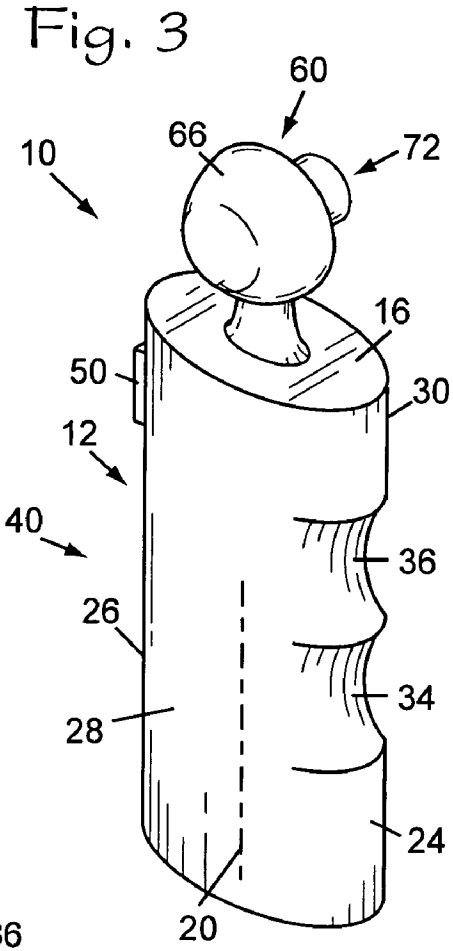
FIG. 3 is a rear perspective view of an electric cigarette lighter embodying the present invention.
Figure 2:
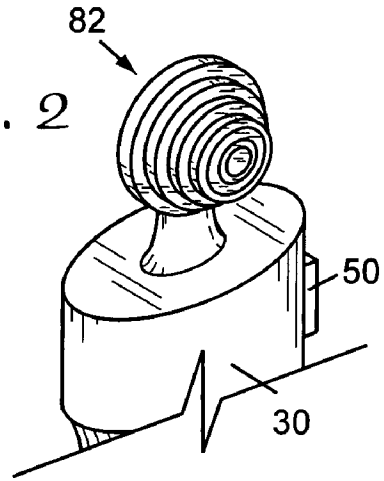
FIG. 2 is a top perspective view of an electric cigarette lighter embodying the present invention.
Figure 4:
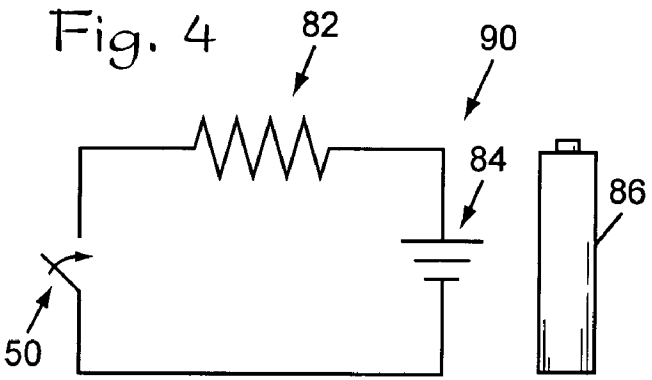
FIG. 4 is a circuit diagram for the power unit included in the electric cigarette lighter embodying the present invention.

Other objects, features and advantages of the invention will become apparent from a consideration of the following detailed description and the accompanying drawings.

Referring to the Figures, it can be understood that the present invention is embodied in an electric cigarette lighter 10 that achieves the above-stated objectives.

Lighter 10 comprises a hollow housing unit 12 which includes a first end 14 that is a bottom end when housing unit 12 is in use, a second end 16 that is a top end when housing unit 12 is in use, and a longitudinal axis 20 that extends between first end 14 and second end 16.

Unit 12 further includes a first side 24, a second side 26, a first face 28 that is a rear face when housing unit 12 is in use, and a second face 30 that is a front face when housing unit 12 is in use.

First and second indentations 34 and 36 are defined in the first side 24, with second indentation 36 being spaced apart from first indentation 34 in the direction of longitudinal axis 20. First and second indentations 34 and 36 define a finger-grip area 40 that permits a user to maintain a firm grip on housing unit 12.

A battery storage compartment 44 is defined through second face 30 and includes a battery storage compartment cover 46 releasably mounted on second face 30 to cover battery storage compartment 44 when in use.

Figure 1:
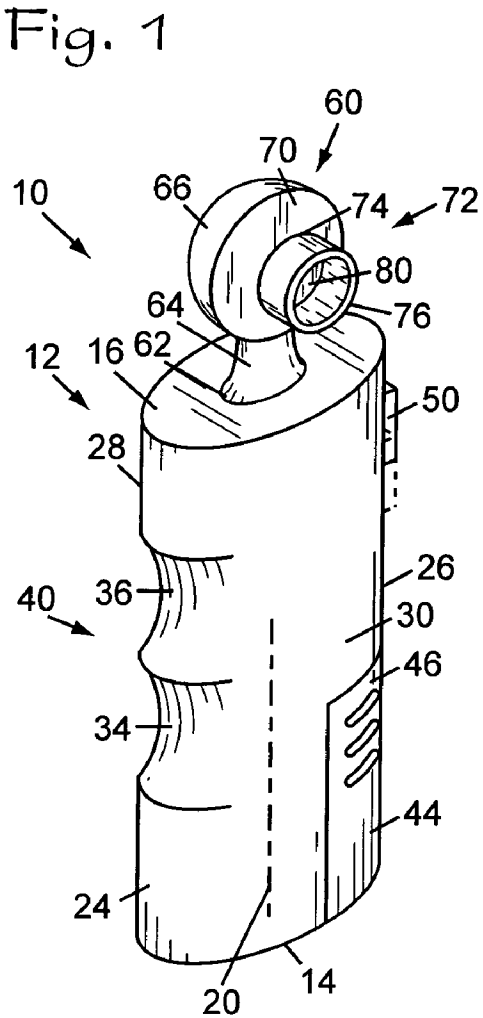
FIG. 1 is a front perspective view of an electric cigarette lighter embodying the present invention.
Figure 6:
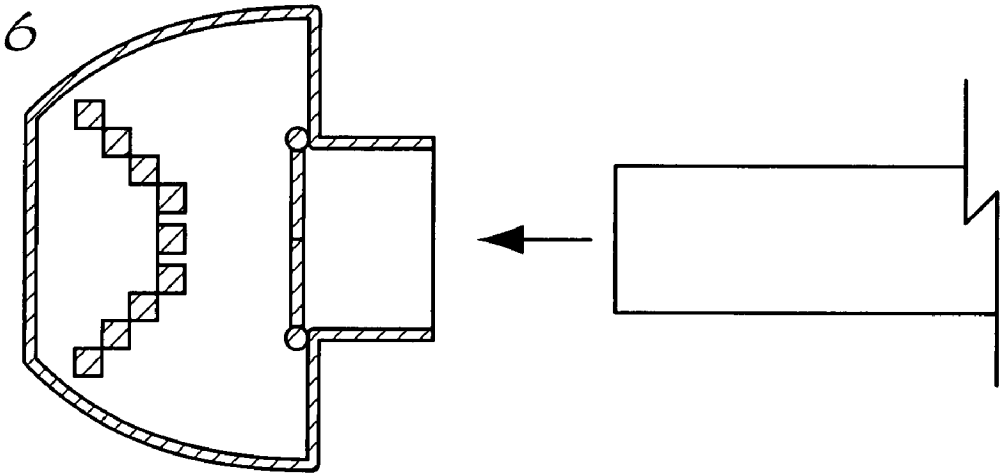
FIG. 6 is a vertical cross-sectional view of a head of the electric cigarette lighter, showing a flap thereof in a proximal end covering position.
Figure 7:
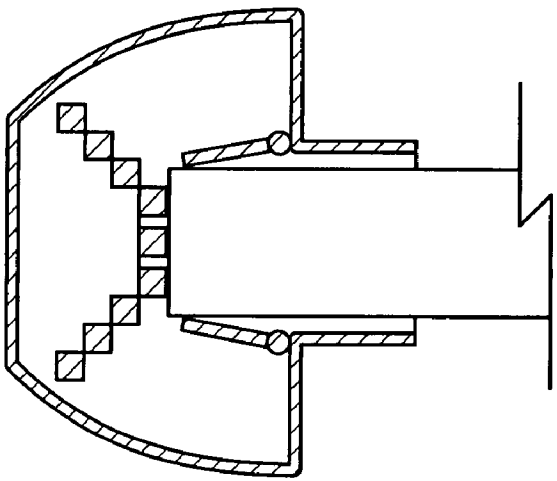
FIG. 7 is a vertical cross-sectional view of the head of the electric cigarette lighter, showing the flap thereof in a proximal end uncovering position, according to the present invention.
Figure 5:
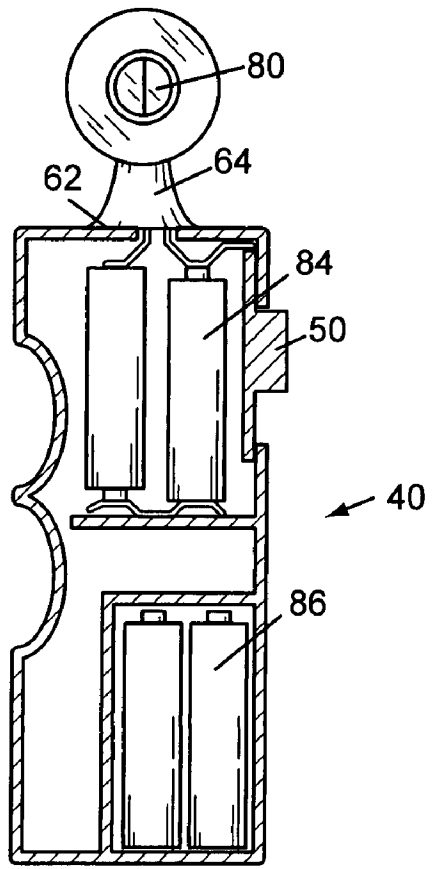
FIG. 5 is a vertical side to side cross-sectional view of the electric cigarette lighter.

An on/off switch 50 is movably mounted on second side 26 and is located near second end 16 of housing 12. Switch 50 is movable between an "on" position shown in solid lines in FIG. 1 and an "off" position shown in FIG. 1 in dotted lines.

A heating element support unit 60 is mounted on second end 16 of housing 12 and includes a base 62 fixed to second end 16, a neck 64 which extends from base 62 in the direction of longitudinal axis 20, and a hollow head 66 on the neck 64.

Head 66 includes a first face 70 that is located near second face 30 of housing unit 12. Head 66 further includes a tubular element 72 having a proximal end 74 on first face 70 and a distal end 76 spaced apart from proximal end 74.

A flap 80 is movably mounted on head 66 adjacent to proximal end 74 of tubular element 72. Flap 80 moves between a proximal end covering position shown in FIG. 1 and a proximal end uncovering position and is biased, by a spring hinge or the like, into the proximal end covering position. Flap 80 is moved into the proximal end uncovering position when an object, such as a cigarette, is forced through tubular element 72 into hollow head 66. In the form shown in FIG. 1, tubular element 72 is sized to slidably accommodate a cigarette in a snug manner so air does not flow into the hollow head when the cigarette forces flap 80 into the uncovering position. This will prevent such air, as well as other environmental factors, from reaching the inside volume of head 66.

A resistive heating element 82 is mounted on second end 16 of housing 12 and is located inside hollow head 66. When flap 80 is closed, air or other environmental factors cannot reach heating element 80.

A power source 84, such as a battery or the like, is located inside housing unit 12, and a reserve power source 86, such as a battery or the like, is located inside battery storage compartment 44.

An electric circuit 90 electrically connects power source 84 to resistive heating element 82 via on/off switch 50 when the on/off switch is in an "on" condition, with power source 84 being electrically separated from the resistive heating element 82 when the on/off switch 50 is in an "off" condition.

Operation of the cigarette lighter 10 will be understood by those skilled in the art based on the teaching of the foregoing disclosure and thus will not be discussed in detail. A user grips housing 12 with his fingers in finger-grip area 40 on indentations 34 and 36 to firmly grasp housing 12. The user then moves switch 50 into an "on" position, and forces a cigarette through tubular element 72 to force flap 80 open. The cigarette is moved until the tip end thereof contacts heating element 82, which by now is hot due to resistive heating. The cigarette will be lit, and can be withdrawn from the tubular element. Switch 50 is then moved back into the "off" position. Should battery 84 fail, it can be easily replaced with reserve battery 86 which is stored on unit 10.

It is understood that while certain forms of the present invention have been illustrated and described herein, it is not to be limited to the specific forms or arrangements of parts described and shown.

What is needed and desired to be covered by Letters Patent is as follows:

1. An electric cigarette lighter comprising:

(a) a hollow housing unit which includes (1) a first end that is a bottom end when said housing unit is in use, (2) a second end that is a top end when said housing unit is in use, (3) a longitudinal axis that extends between the first end and the second end, (4) a first side, (5) a second side, (6) a first face that is a rear face when said housing unit is in use, (7) a second face that is a front face when said housing unit is in use, (8) first and second indentations defined in the first side, the second indentation being spaced apart from the first indentation in the direction of the longitudinal axis, (9) a battery storage compartment defined through the second face,

(10) a battery storage compartment cover releasably mounted on the second face and covering the battery storage compartment when in use, and

(11) an on/off switch movably mounted on the second side and located near the second end of said housing;

(b) a heating element support unit mounted on the second end of said housing and including (1) a base fixed to the second end of said housing, (2) a neck which extends from the base in the direction of the longitudinal axis of said housing, and (3) a hollow head on the neck, the head including (A) a first face that is located near the second face of said housing unit, (B) a tubular element having a proximal end on the first face of the head of said heating element support unit and a distal end spaced apart from the proximal end, and (C) a flap movably mounted on the head adjacent to the proximal end of the tubular element, the flap moving between a proximal end covering position and a proximal end uncovering position and being biased into the proximal end covering position and being moved into the proximal end uncovering position when an object is forced through the tubular element into the hollow head;

(c) a resistive heating element mounted on the second end of said housing and located inside the hollow head of said heating element support unit;

(d) a power source located inside said housing unit;

(e) a reserve power source located inside the battery storage compartment of said housing unit; and (f) an electric circuit electrically connecting said power source to said resistive heating element via the on/off switch when the on/off switch is in an "on" condition, said power source being electrically separated from said resistive heating element when the on/off switch is in an "off" condition.

* * * * *